US007100921B2

(12) United States Patent
Yercha et al.

(10) Patent No.: US 7,100,921 B2
(45) Date of Patent: Sep. 5, 2006

(54) TOSS GAME

(76) Inventors: Nickolas Wayne Yercha, #6-216 Russell Street, Victoria, British Columbia (CA) V9A 3X2; Richard Craig Soergel, 6160 Fairmount Ave., #F, San Diego, CA (US) 92120

( * ) Notice: Subject to any disclaimer, the term of this patent is extended or adjusted under 35 U.S.C. 154(b) by 0 days.

(21) Appl. No.: 10/977,825

(22) Filed: Oct. 29, 2004

(65) Prior Publication Data

US 2006/0091608 A1 May 4, 2006

(51) Int. Cl.
*A63B 67/06* (2006.01)

(52) U.S. Cl. ..... 273/348.4

(58) Field of Classification Search ..... 273/348–402
See application file for complete search history.

(56) References Cited

U.S. PATENT DOCUMENTS

| | | | | |
|---|---|---|---|---|
| 3,895,804 | A | 7/1975 | Lee | |
| 3,997,162 | A | 12/1976 | Scullin | |
| 4,183,530 | A | 1/1980 | Roop | |
| 4,667,964 | A * | 5/1987 | Hickey | 473/172 |
| 4,736,955 | A | 4/1988 | Pollock | |
| 4,863,176 | A | 9/1989 | Lapkewych | |
| 4,943,065 | A | 7/1990 | DeLapa | |
| 4,953,870 | A | 9/1990 | Norman et al. | |
| 5,232,217 | A | 8/1993 | Cota et al. | |
| RE34,461 | E | 11/1993 | Buselli | |
| 5,324,042 | A | 6/1994 | Demas | |
| 5,332,230 | A | 7/1994 | Benedict | |
| 5,524,881 | A * | 6/1996 | Edward | 473/447 |
| 5,549,302 | A | 8/1996 | Lapsker et al. | |
| 5,603,504 | A | 2/1997 | Powell | |
| 5,871,216 | A * | 2/1999 | Sparacino | 273/402 |
| 6,299,172 | B1 | 10/2001 | McMurray | |
| 6,361,047 | B1 | 3/2002 | Militello | |
| 6,755,711 | B1 * | 6/2004 | McClung et al. | 446/46 |

* cited by examiner

*Primary Examiner*—Mark S. Graham
(74) *Attorney, Agent, or Firm*—Charles J. Prescott

(57) ABSTRACT

A toss game comprising in combination a multi-panel assembly including generally flat multiple substantially identically shaped panels each having first and second surfaces bearing printed design indicia thereon. Each of the side margins of the middle panel is hinge connected to one side margin of each of the two end panels whereby the end panels are pivotally extendable into a generally planar relation one to another and to the middle panel in an open flat configuration and foldable against the middle panel in a closed configuration. The end panels are also attachable along a distal edge of each of said end panels to form a self-supporting polyhedron shape which is preferably a truncated pyramid. A portion of the panel surfaces is partially covered with a hook and loop material to form target areas at which a throw piece of sufficient weight is thrown. Each throw piece has printed design indicia on an obverse surface and hook and loop material attached to a reverse surface making the throw piece self-attaching when properly thrown against one of the target areas.

13 Claims, 9 Drawing Sheets

TOSS GAME

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to toss games with throwable pieces, and more particularly to a toss game having multiple functions and configurations for tossing and stowing throwable design pieces.

2. Description of Related Art

Games which include throwable projectiles or throw pieces against a target are well known, starting with the game of darts. In U.S. Pat. No. 6,299,172, McMurray teaches a game with throwable pieces and variable target assembly, the game relying upon hook and loop releasable attaching material to implement attachment of the throwable pieces to the target assembly. Buselli, in Re 34,461 teaches a wall mounted decorative art apparatus convertible to a toss game with a catch area to collect the tossable projectiles against a plurality of hook material targets.

In U.S. Pat. No. 4,736,955, Pollock teaches a pitch and toss game which includes a target and a plurality of throwing objects incorporating hook and loop material to effect attachment of the thrown object against the upper surface of the target. An aerial projectile and target apparatus for a lawn target game invented by Demas is disclosed in U.S. Pat. No. 5,324,042. A bag-like throwing member is thrown against a target defining a plurality of target zones. Only one side of the weighted throwing member includes hook and loop material to heighten the game challenge.

Another ball throw game is disclosed in U.S. Pat. No. 4,863,176 by Lapkewych teaching an upright target board formed of hook and loop material to releasably attach to a thrown ball striking the target board surface. Portions of the target board do not include the hook and loop material to heighten the game's challenge.

A beanbag toss game includes a target structure against which the bean bags are tossed is shown in U.S. Pat. No. 5,332,230. The target surface is at an incline and the target area is relatively small to heighten game challenge. A triple play game invented by Cota, et al. and disclosed in U.S. Pat. No. 5,232,217 teaches three separate games of basketball, tetherball and target board all utilizing the same vertical pole net and backboard to play each of the individual games.

The following additional U.S. patents teach various additional forms of toss games against the target, the majority of which incorporate hook and loop material to effect attachment of the tossed object against the specifically structured target area as follows:

U.S. Pat. No. 4,183,530 to Roop

U.S. Pat. No. 5,549,302 to Lapsker, et al.

U.S. Pat. No. 5,603,504 to Powell

U.S. Pat. No. 3,895,804 to Lee

U.S. Pat. No. 3,997,162 to Scullin

U.S. Pat. No. 4,953,870 to Norman, et al.

U.S. Pat. No. 4,943,065 to DeLapa

U.S. Pat. No. 6,361,047 to Militello

The present invention provides a multi-faceted toss game utilizing a plurality of disc-shaped design enhanced throw pieces and a multi-paneled assembly having design indicia printed on both sides of each panel. The panels are hingedly connected together and pivotally moveable from a flattened configuration which may be wall hung to a polyhedron configuration to a closed configuration for protectively holding and carrying a plurality of the throw pieces themselves.

BRIEF SUMMARY OF THE INVENTION

This invention is directed to a toss game comprising in combination a multi-panel assembly including generally flat multiple substantially identically shaped panels each having first and second surfaces bearing printed design indicia thereon. Each of the side margins of the middle panel is hinge connected to one side margin of each of the two end panels whereby the end panels are pivotally extendable into a generally planar relation one to another and to the middle panel in an open flat configuration and foldable against the middle panel in a closed configuration. The end panels are also attachable along a distal edge of each of said end panels to form a self-supporting polyhedron shape which is preferably a truncated pyramid. A portion of the panel surfaces is partially covered with a hook and loop material to form target areas at which a throw piece of sufficient weight is thrown. Each throw piece has printed design indicia on an obverse surface and hook and loop material attached to a reverse surface making the throw piece self-attaching when properly thrown against one of the target areas.

It is therefore an object of this invention to provide a toss game comprising a multi-panel assembly and one or more distinctively configured toss pieces.

Still another object of this invention is to provide toss game which includes a multi-panel assembly which is configurable into a plurality of configurations for storage, display, and throw piece tossing play either in the deployed configuration in the flat or as a polyhedron.

Yet another object of this invention is to provide a toss game which includes a plurality of panels and a multi-panel assembly each of which may include discrete areas of hook and loop material which releasably attach to each of a plurality of throw pieces having a like surface to effect releasable attachment when properly thrown.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
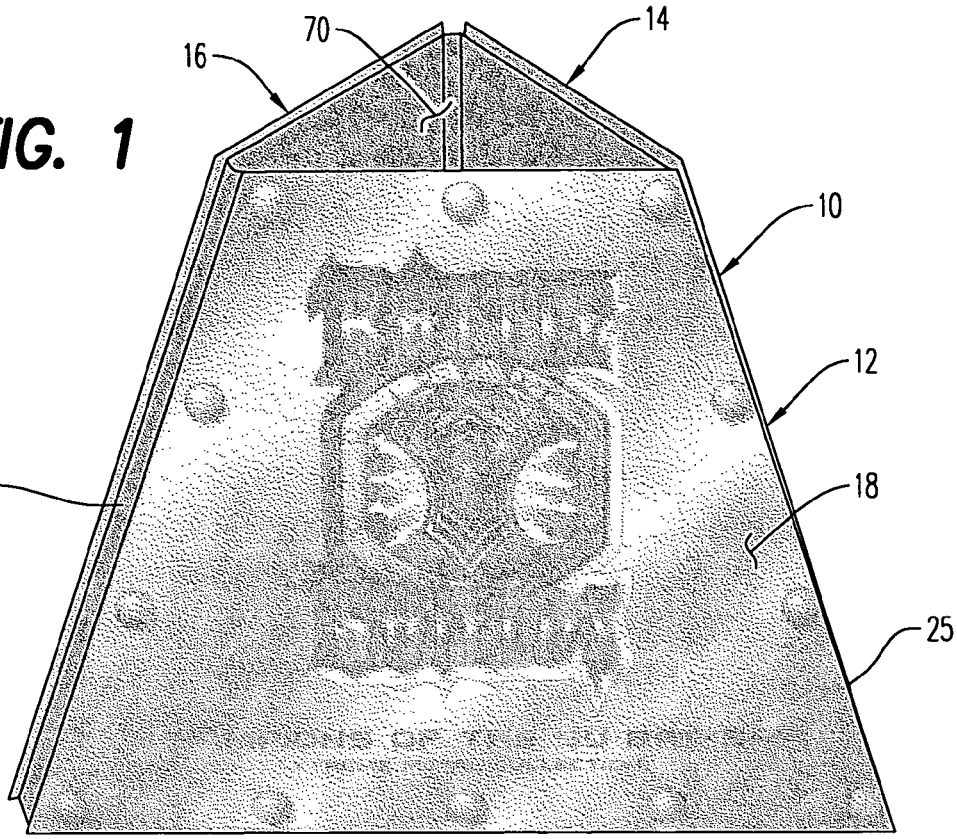
FIG. 1 is a perspective view of the invention in an open three dimensional polyhedron configuration.

Referring now to the drawings, the multi-panel assembly of the invention is shown generally at numeral 10 in combination with a toss piece shown at 60 in FIGS. 11 to 14. The multi-panel assembly 10 includes three generally flat substantially rigid panels 12, 14, and 16, each of which have a first facing surface 18, 20 and 22, respectively bearing printed design indicia thereon while the opposite facing surfaces 34, 36 and 38, respectively also bear printed design indicia thereon.

Figure 15:
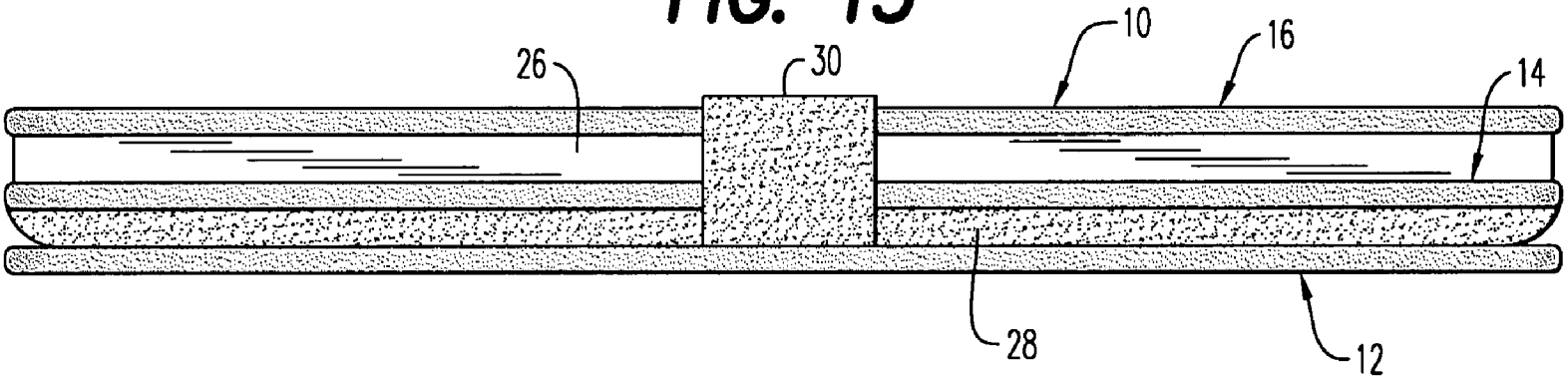
FIG. 15 is an edge view of the assembly 10 in the closed configuration.

The panels 12, 14, and 16 are fabricated of substantially rigid or semi-rigid heavy paper stock with the printed design indicia printed or applied thereto. These panels 12, 14, and 16 are hingedly connected together by fabric or heavy paper hinges 24 and 26 such that the panels 12, 14, and 16 may be freely pivotally moved from the outstretched flattened configuration best seen in FIGS. 5 to 10 to a three dimensional second in use or open configuration as seen in FIGS. 1 to 4. These panels 12, 14, and 16 are also foldable atop one another in book type fashion as seen in FIG. 15 and held in this closed configuration by mating two part tabs 30 and 32 which are releasably connectable together when the assembly 10 is in the closed configuration.

Figure 2:
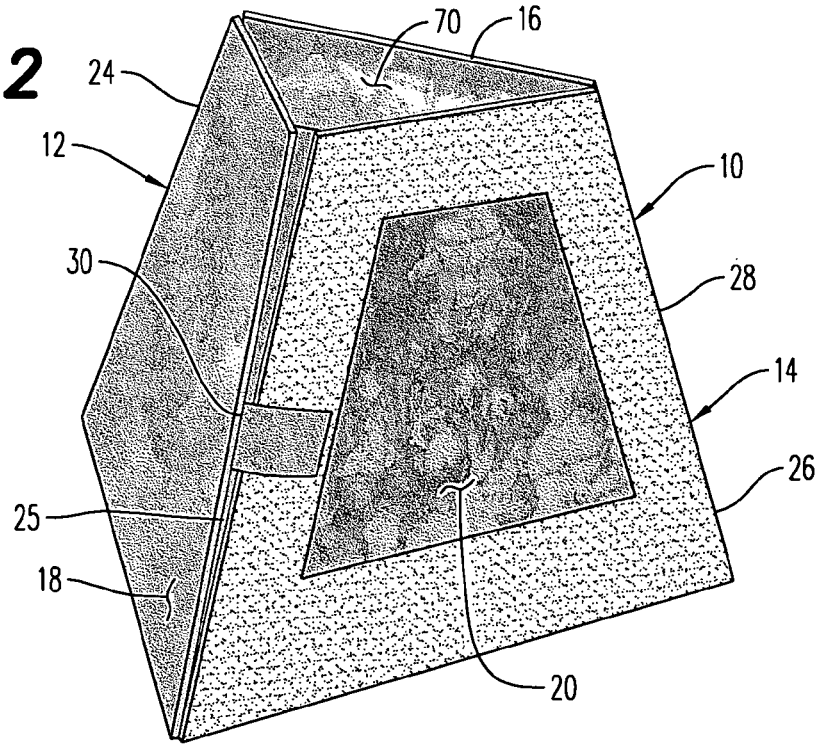
FIG. 2 is another perspective view of FIG. 1.
Figure 3:
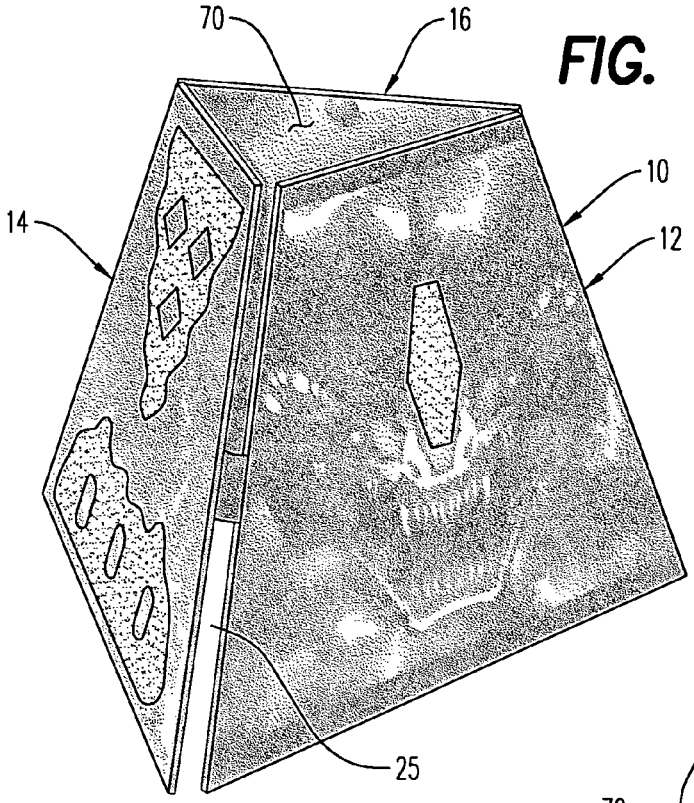
FIG. 3 is still another perspective view of FIG. 1 with the multi-panel assembly in a reversed inside to outside orientation.
Figure 4:
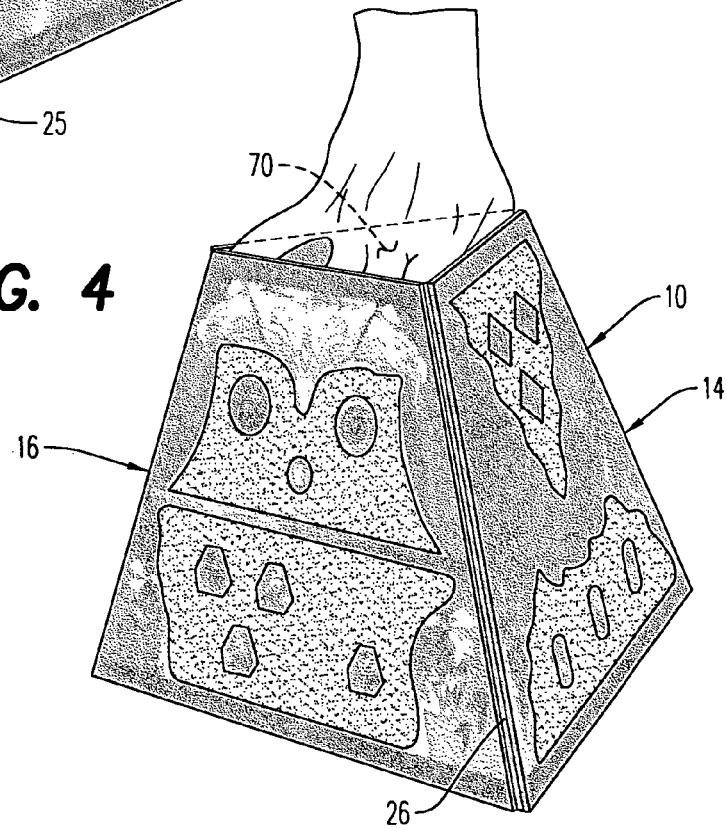
FIG. 4 is a perspective view of FIG. 3 depicting easy hand pickup of the multi-panel assembly in this open configuration.

When in the first open configuration as a polyhedron-like structure as seen in FIGS. 1 to 4, the assembly 10 may be oriented with surfaces 18, 20 and 22 outwardly showing as seen in FIGS. 1 and 2 or with surfaces 34, 36 and 38 outwardly showing as seen in FIGS. 3 and 4. In either of these three dimensional open configurations, the mating hook and loop tabs 30 and 32 releasably attach the distal margins of panels 12 and 14 together at 25 as best seen in FIGS. 1, 2 and 3.

Figure 5:
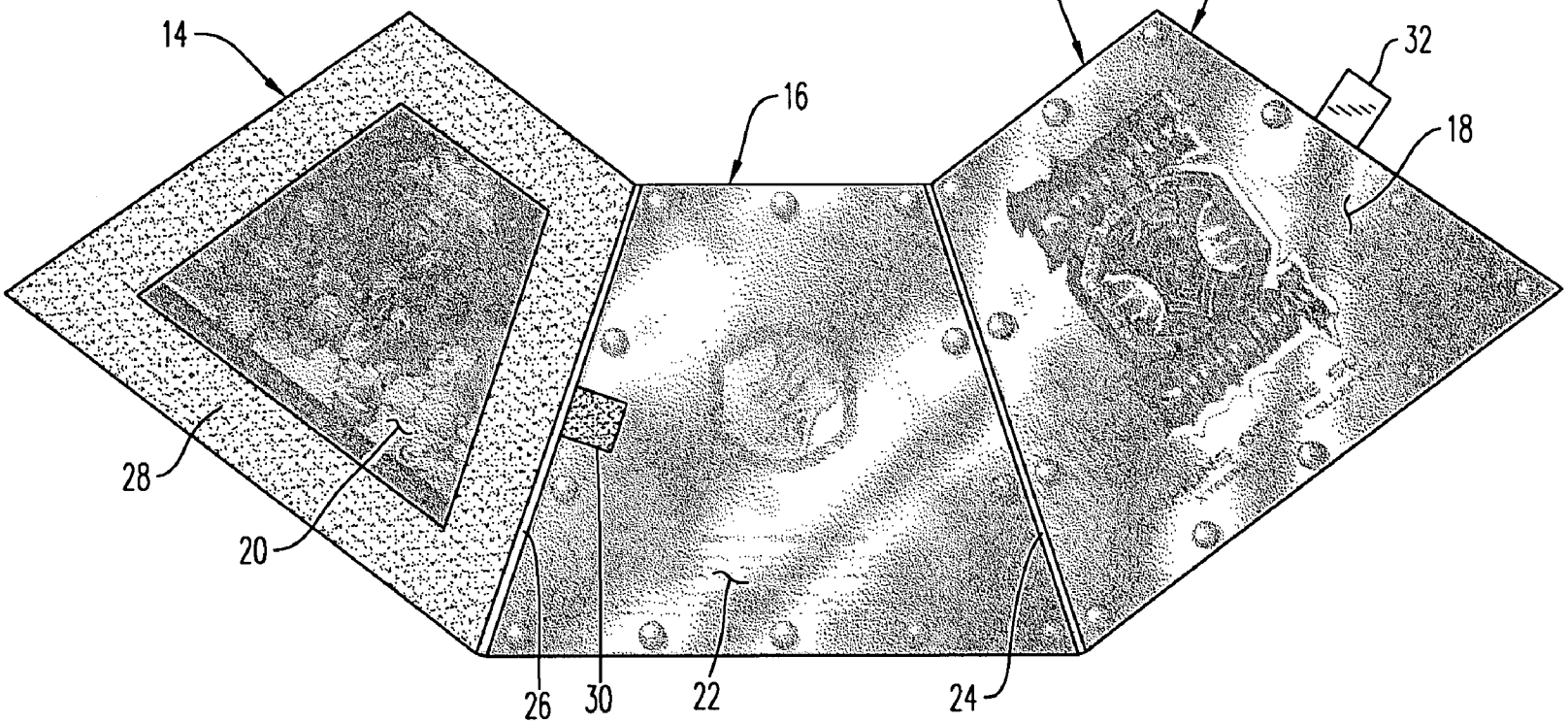
FIG. 5 is a plan view of one of the side surfaces of the printed design indicia shown in the flat open configuration.
Figure 6:
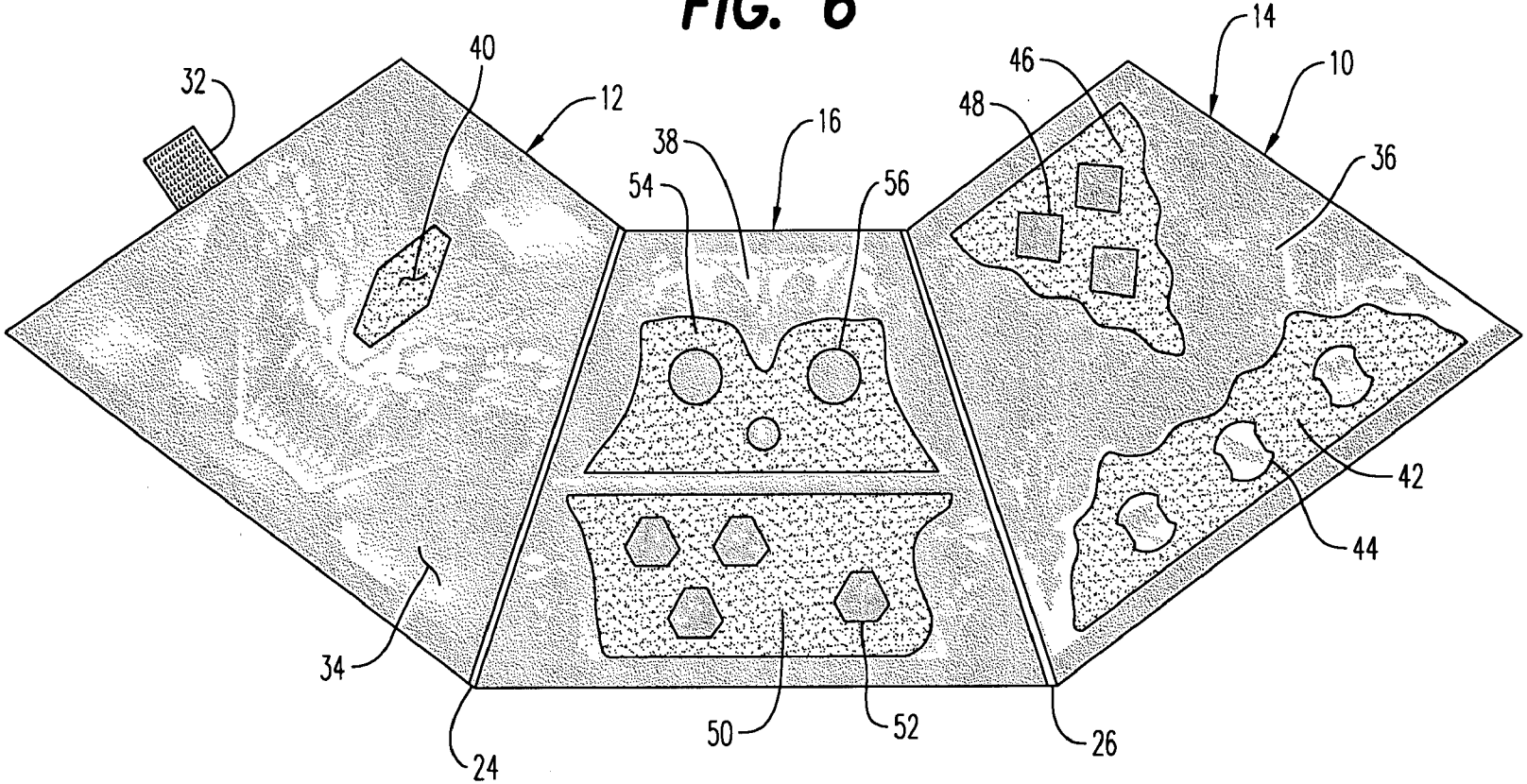
FIG. 6 is a plan view of the reverse surfaces of the assembly shown in FIG. 5.
Figure 7:
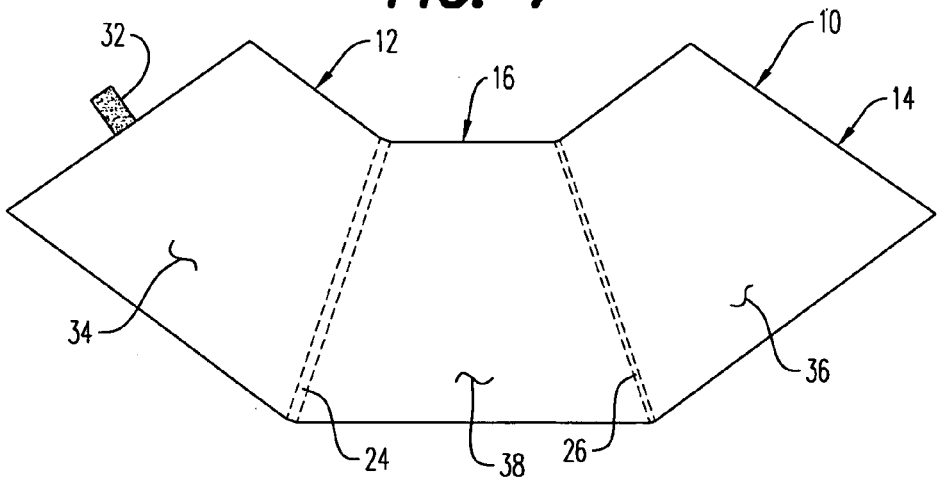
FIG. 7 is a simplistic schematic view of FIG. 6 absent the printed design indicia for clarity.
Figure 8:
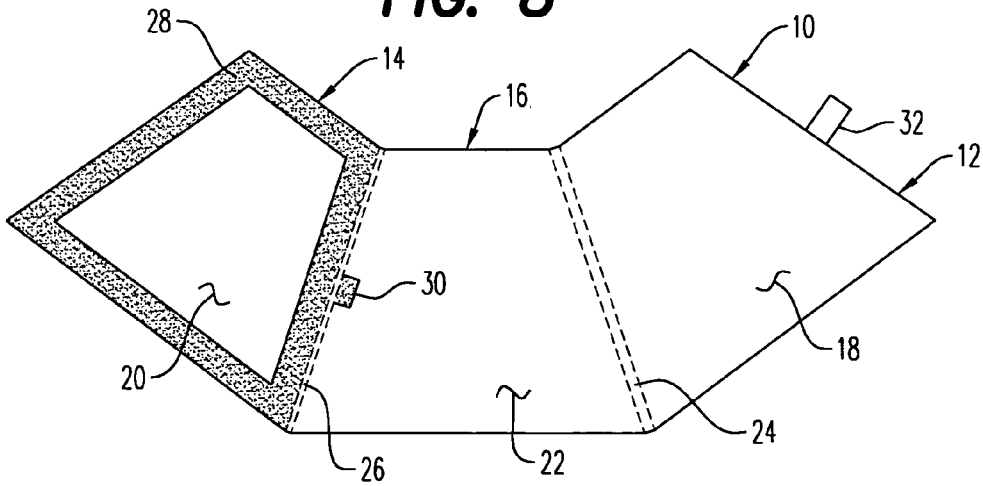
FIG. 8 is a view similar to FIG. 7 of FIG. 5.

It is noted that any embodiments having at least three panels whether rectangular or triangular in shape or, preferably truncated triangular shape as shown in the Figures, are within the intended scope of this invention. In the preferred embodiment 10, however, all of the panels 12, 14, and 16 are of a truncated triangular shape in plan view and of substantially equal dimensions producing advantageous features in either of the open configurations. As seen in FIG. 4, the upper open end 70 may be utilized to hand lift the invention 10 by simply inserting the hand and spreading the fingers within the upper open end 70. When in the open outstretched or flattened configuration, as best seen in FIGS. 5 and 6, either arrangement of the printed design indicia surfaces 18/20/22 in FIG. 5 or 34/36/38 in FIG. 6 may be displayed atop a horizontal or slanted flat surface or attached to an upright wall surface for display or game toss play.

Figure 9:
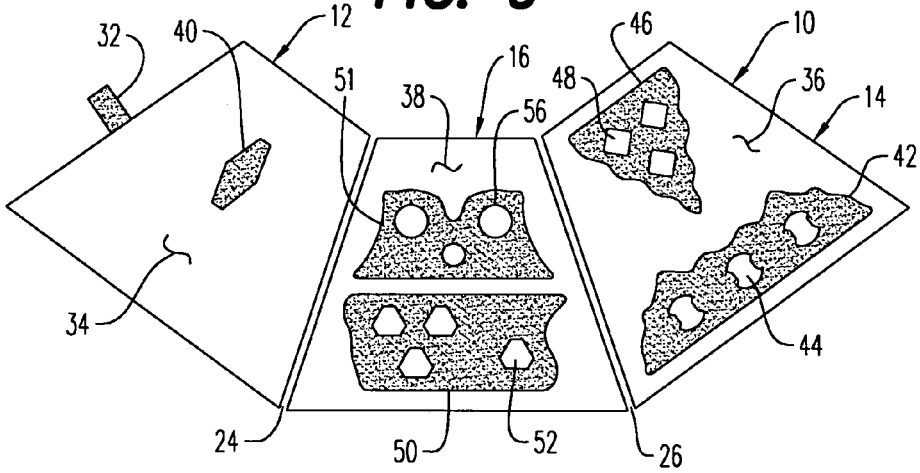
FIG. 9 is a simplistic schematic view of FIG. 6 showing the hook and loop discrete target areas and absent the printed design indicia for clarity.
Figure 10:
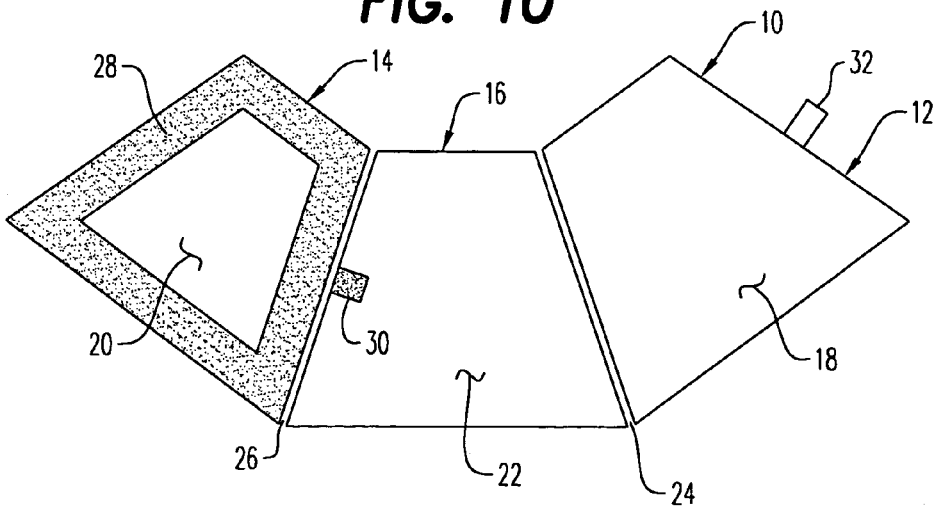
FIG. 10 is a view similar to FIG. 9 of FIG. 5.
Figure 11:
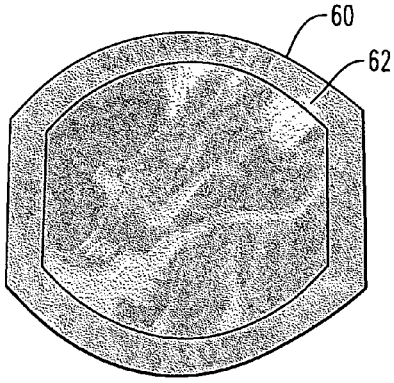
FIG. 11 is a plan view of one surface showing typical printed design indicia of the throw piece.
Figure 12:
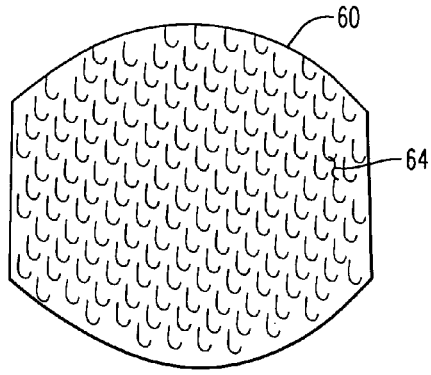
FIG. 12 is a plan view of the reverse surface of FIG. 11.

As best seen in FIGS. 9 and 10, each of the panel surfaces 20, 34, 36 and 38 includes segments of hook and loop material attached thereto which define target areas 28, 40, 42, 46, 50 and 51. Each of these target areas 28, 40, 42, 46, 50 and 51 are formed of hook or loop material which releasably attach with the reverse surface 64 of each of the throw pieces 60 shown in FIGS. 11 to 14 and described more fully herebelow. Each of these target areas 28, 40, 42, 46, 50 and 51 are distinctively configured to present distinctive challenges to the toss game aspect of this invention and may carry varying amounts of points related to degree of difficulty or defined by the adjacent indicia. More specifically, target area 28 is formed as a periphery strip around the outer margins or periphery of panel 14, target area 40 is small and diamond shaped simulating a crystal above the nostrils of a design monster on panel 34, and target areas 40, 42, 46, 50 and 51 include spaced apertures 44, 48, 52 and 56, with indicia within corresponding to varying amounts of points to be awarded for at least partially covering the aperture with a throw piece.

Figure 14:
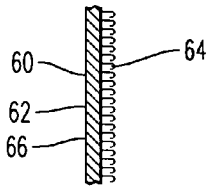
FIG. 14 is a partial cross section view through the throw pieces 60 of FIG. 11.

Turning to FIGS. 11 to 14, the throw piece 60 is formed as best seen in FIG. 14 of a flat plate 66 preferably formed of metal and optionally of metals of different densities and having an etched, painted, or stamped design indicia 62 imprinted thereon. The preferred width and thickness of this plate 66 are approximately 1½" and 1/16", respectively, providing weight sufficient to be easily thrown or tossed at one of the target areas previously described. The shape size and material composition of the plate may vary so as to change tossing characteristics to correspond with the theme of the indicia and/or indicate a special scoring point or play value. The reverse surface of the throw piece 60 is covered with an adhesively attached sheet of loop or hook material 64 which is releasably attachable to any one of the target areas when proper contact is made therebewteen at the end of a toss of the throw piece 60. This toss game may be played as previously described with the assembly 10 either formed into the open three dimensional configuration supported atop a surface as in FIGS. 1 to 4, or in the flat open configuration as best seen in FIGS. 5 and 6 atop a horizontal, slanted or upright surface.

Figure 13:
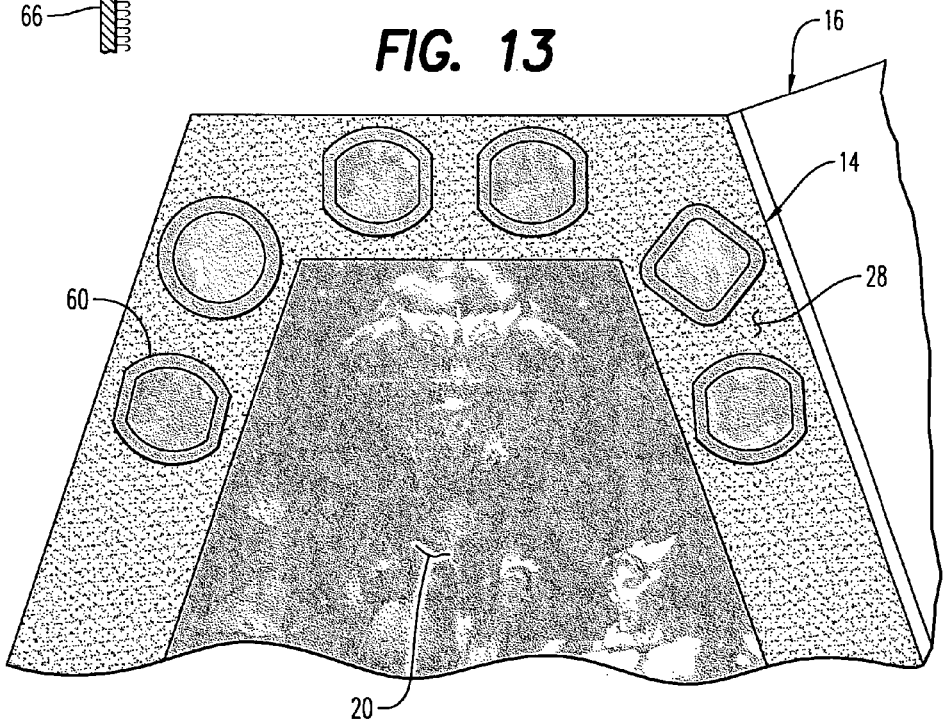
FIG. 13 is a partial view of one surface of one of the assembly panels showing a plurality of throw pieces generally similar to that shown in FIG. 11 attached to the target area.

Additionally as seen in FIG. 13, the target area 28 may preferably be utilized to display a plurality of these throw pieces 60 releasably attached to any of the hook and loop target areas, e.g. at 28 as previously described and allows pieces to be protectively stored there while play is taking place on the reverse side. Again, display may be achieved in any of the open configurations of the assembly 10. Moreover, the assembly 10 may be folded closed in book or album fashion as shown in FIG. 15 whereby the throw pieces 60 are protectively stored and easily transported without concern for loss or damage thereto.

Figure 16:
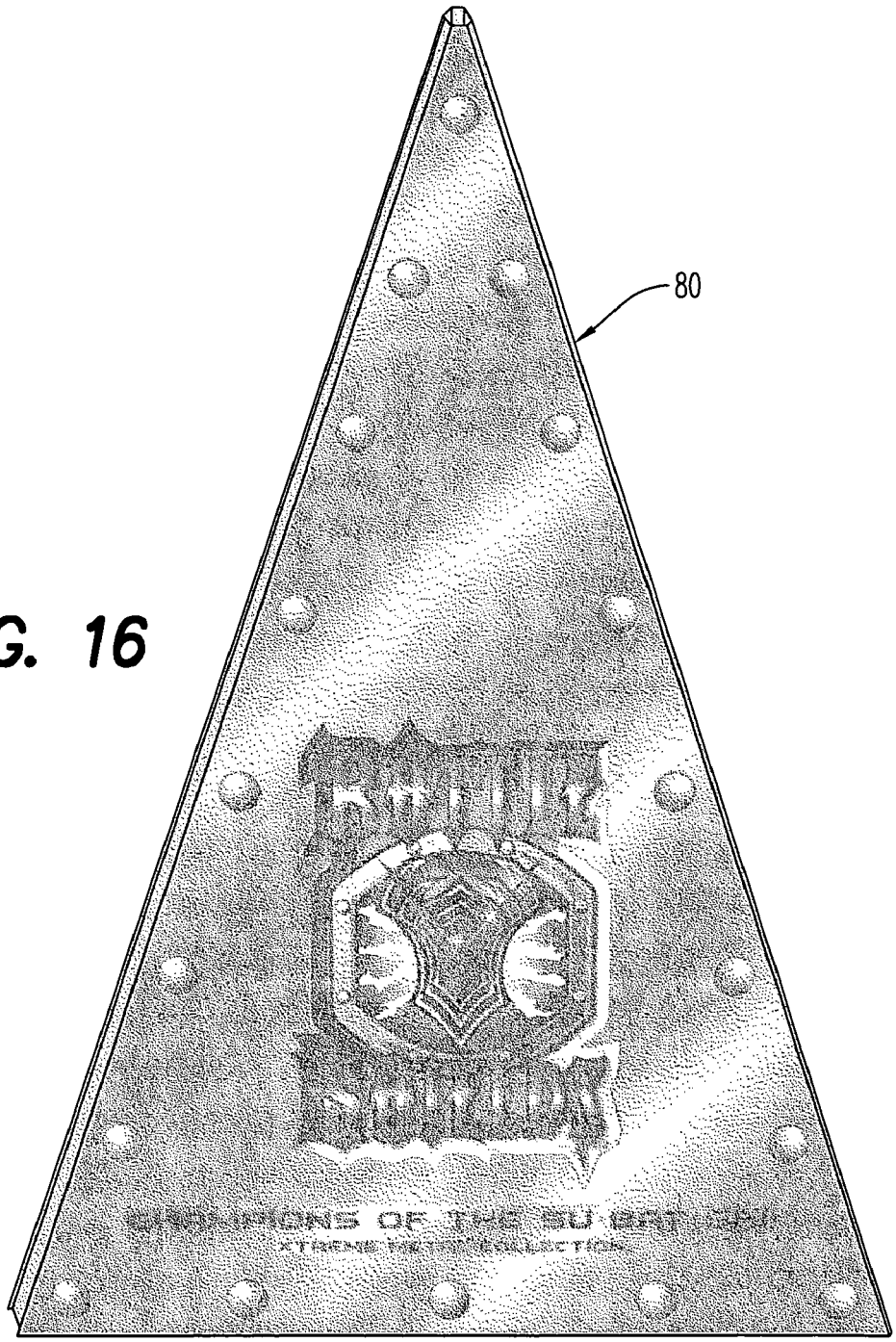
FIG. 16 is a perspective view of another embodiment of the invention of FIG. 1.

FIG. 16 depicts the invention with the triangular shaped panels.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A toss game comprising in combination:

a multi-panel assembly including three generally flat, substantially rigid panels each having first and second surfaces bearing printed design indicia thereon and a periphery including a top edge, a bottom edge and first and second side edges extending between said top and bottom edges;

said side margins of a middle one of said panels hinge connected to one said side margin of each of the end two of said panels wherein said end panels are extendable in generally planar relation one to another and to said middle panel into a first open flat configuration of said assembly and foldable against said middle panel in a closed configuration of said assembly, said end panels also foldable to bring a distal edge of each of said end panels into releasable attachment together into a second open position to form a self-supporting polygon shape of said assembly;

a portion of at least one of said panel surfaces being partially covered with a hook and loop material to define a target area;

a throw piece of sufficient weight to be thrown against said assembly in the open positions, said throw piece having printed design indicia on an obverse surface thereof and hook and loop material attached to a reverse surface of said throw piece, said reverse surface self-attaching said throw piece onto one said target area when said throw piece is thrown or placed thereagainst;

each of said panels having a triangular shaped said periphery and said polyhedron shape is a three-sided pyramid.

2. A toss game as set forth in claim 1, wherein:

one said target area is interrupted by spaced apertures sized to reduce the size of said one target area for enhanced throwing challenge of said throw piece thereagainst.

3. A toss game as set forth in claim 2, wherein:

another of said target areas extends only around said periphery of one said panel.

4. A toss game as set forth in claim 1, further comprising:

releasable closure tabs formed of mating hook and loop material for releasably securing said assembly in said closed or said second open configuration.

5. A toss game as set forth in claim 1, wherein:

said assembly is hangable onto a wall surface in the first open configuration with either of said first or second surfaces outwardly facing for throwing said throw piece thereagainst or for displaying a plurality of said throw pieces when releasably attached to at least one of said target areas.

6. A toss game as set forth in claim 1, wherein:

said assembly is a protective carrier for a plurality of said target pieces attached to one or more said target areas and said assembly is in the closed configuration.

7. A toss game comprising in combination:

a multi-panel assembly and a plurality of throw pieces;

said assembly including a plurality of like-shaped generally flat, substantially rigid panels each having first and second surfaces bearing printed design indicia thereon and a periphery including a top edge, a bottom edge and first and second side edges extending between said top and bottom edges;

said side margins of said panels hinge connected together in side edge-to-side edge fashion to be extendable in generally planar relation one to another into a first open flat configuration of said assembly and foldable against one another in a closed configuration of said assembly, said panels also being selectively positionable into a second open position to form a self-supporting polyhedron shape of said assembly;

a portion of said panel surfaces partially covered with a hook and loop material to define a plurality of target areas;

said throw pieces of sufficient weight to be thrown or tossed against said assembly in the open positions and having printed design indicia on an obverse surface thereof and hook and loop material attached to a reverse surface of said throw piece, said reverse surface self-attaching said throw piece onto one said panel surface bearing hook and loop material when said throw piece is thrown or placed thereagainst;

each of said panels has a triangular or truncated triangular shaped said periphery and said polyhedron shape is a three-sided pyramid or truncated pyramid, respectively.

8. A toss game as set forth in claim 7, wherein:

one said target area is interrupted by spaced apertures sized to reduce the size of said one target area for enhanced throwing challenge of said throw piece thereagainst.

9. A toss game as set forth in claim 8, wherein:

another of said target areas extends only around said periphery of one said panel.

10. A toss game as set forth in claim 7, further comprising:

releasable closure tabs formed of mating hook and loop material for releasably securing said assembly in said closed or said second open configuration.

11. A toss game as set forth in claim 7, wherein:

said assembly is hangable onto a wall surface in the first open configuration with either of said first or second surfaces outwardly facing for throwing said throw piece thereagainst or for displaying a plurality of said throw pieces when releasably attached to at least one of said target areas.

12. A toss game as set forth in claim 7, wherein:

said assembly is a protective carrier for a plurality of said target pieces attached to one or more said target areas and said assembly is in the closed configuration.

13. A toss game comprising in combination:

a multi-panel assembly including three generally flat, substantially rigid panels each having first and second surfaces bearing printed design indicia thereon and a periphery including a top edge, a bottom edge and first and second side edges extending between said top and bottom edges;

said side margins of a middle one of said panels hinge connected to one said side margin of each of the end two of said panels wherein said end panels are extendable in generally planar relation one to another and to said middle panel into a first open flat configuration of said assembly and foldable against said middle panel in a closed configuration of said assembly, said end panels also foldable to bring a distal edge of each of said end panels into releasable attachment together into a second open position to form a self-supporting polygon shape of said assembly;

a portion of at least one of said panel surfaces being partially covered with a hook and loop material to define a target area; a throw piece of sufficient weight to be thrown against said assembly in the open positions, said throw piece having printed design indicia on an obverse surface thereof and hook and loop material attached to a reverse surface of said throw piece, said reverse surface self-attaching said throw piece onto one said target area when said throw piece is thrown or placed thereagainst;

each of said panels has a truncated triangular shaped said periphery and said polyhedron shape is a three-sided truncated pyramid.

* * * * *